US009707661B2

(12) United States Patent
Shinozaki

(10) Patent No.: US 9,707,661 B2
(45) Date of Patent: Jul. 18, 2017

(54) POLISHING METHOD AND POLISHING APPARATUS

(71) Applicant: EBARA CORPORATION, Tokyo (JP)

(72) Inventor: Hiroyuki Shinozaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 196 days.

(21) Appl. No.: 14/847,745

(22) Filed: Sep. 8, 2015

(65) Prior Publication Data

US 2016/0114456 A1 Apr. 28, 2016

(30) Foreign Application Priority Data

Sep. 12, 2014 (JP) ..... 2014-186404

(51) Int. Cl.
*B24B 37/20* (2012.01)

(52) U.S. Cl.
CPC ..... *B24B 37/20* (2013.01)

(58) Field of Classification Search
CPC ..... B24B 37/20
USPC ..... 451/259, 41
See application file for complete search history.

(56) References Cited

U.S. PATENT DOCUMENTS 5,935,337 A * 8/1999 Takeuchi ..... C23C 16/45565 118/715
6,402,598 B1 * 6/2002 Ahn ..... B24B 37/345 451/288
7,942,725 B2 * 5/2011 Torii ..... B24B 37/345 451/11
2011/0159783 A1 * 6/2011 Fukushima ..... B24B 37/042 451/11
2014/0011305 A1 * 1/2014 Nakamura ..... B24B 37/30 438/14
2015/0151401 A1 * 6/2015 Shinozaki ..... B24B 37/04 451/5
2016/0074994 A1 * 3/2016 Shinozaki ..... B24B 37/042 451/59

FOREIGN PATENT DOCUMENTS

JP 2005-123485 A 5/2005
JP 2010-046756 A 3/2010
JP 2010046756 A * 3/2010 ..... B24B 37/042
JP 2011-258639 A 12/2011
JP 2011258639 A * 12/2011

* cited by examiner

*Primary Examiner* — Marc Carlson
(74) *Attorney, Agent, or Firm* — Pearne & Gordon LLP

(57) ABSTRACT

A polishing method which can properly inflate a membrane of a polishing head when a substrate, such as a wafer, is released from the polishing head, is disclosed. In this method, the substrate is polished while moving a polishing table and the polishing head relative to each other. The polishing head has a substrate holding surface and a membrane formed by a membrane. Further, a secondary-side valve is closed and a primary-side valve is opened, thereby storing a fluid, having a pressure adjusted by a pressure regulator, in a fluid storage element. The primary-side valve is then closed and the secondary-side valve is opened to supply the fluid from the fluid storage element into a pressure chamber of the polishing head, thereby inflating the membrane to form a gap between the substrate and the membrane. A releasing shower is ejected into this gap to thereby release the polished substrate from the polishing head.

10 Claims, 10 Drawing Sheets

POLISHING METHOD AND POLISHING APPARATUS

CROSS REFERENCE TO RELATED APPLICATION

This document claims priority to Japanese Patent Application Number 2014-186404 filed Sep. 12, 2014, the entire contents of which are hereby incorporated by reference.

BACKGROUND

With a recent trend toward higher integration and higher density in semiconductor devices, circuit interconnects become finer and finer and the number of levels in multilayer interconnect is increasing. In the process of achieving the multilayer interconnect structure with finer interconnects, film coverage of step geometry (or step coverage) is lowered through thin film formation as the number of interconnect levels increases, because surface steps grow while following surface irregularities on a lower layer. Therefore, in order to fabricate the multilayer interconnect structure, it is necessary to improve the step coverage and planarize the surface in an appropriate process. Further, since finer optical lithography entails shallower depth of focus, it is necessary to planarize surfaces of semiconductor device so that irregularity steps formed thereon fall within a depth of focus in optical lithography.

Accordingly, in a manufacturing process of the semiconductor devices, a planarization technique of a surface of the semiconductor device is becoming more important. The most important technique in this planarization technique is chemical mechanical polishing. This chemical mechanical polishing (which will be hereinafter called CMP) is a process of polishing a substrate, such as a wafer, by placing the substrate in sliding contact with a polishing pad while supplying a polishing liquid containing abrasive grains, such as silica ($SiO_2$), onto the polishing pad.

A polishing apparatus for performing CMP includes a polishing table that supports a polishing pad having a polishing surface, and a substrate holder, which is referred to as a polishing head or a top ring, for holding a wafer. When the wafer is polished with such a polishing apparatus, the polishing table and the polishing head are moved relative to each other while supplying the polishing liquid (slurry) onto the polishing pad disposed on the polishing table, and the wafer is pressed against the polishing surface of the polishing pad at a predetermined pressure by the polishing head. The wafer is brought into sliding contact with the polishing surface in the presence of the polishing liquid, so that the surface of the wafer is polished to a flat and mirror finish.

In such polishing apparatus, if a relative pressing force applied between the wafer and the polishing surface of the polishing pad during polishing is not uniform over the entirety of the surface of the wafer, insufficient polishing or excessive polishing would occur depending on the pressing forces applied to respective portions of the wafer. Thus, in order to even the pressing force applied to the wafer, the polishing head has a pressure chamber formed by an elastic membrane (or a membrane) at a lower part thereof. This pressure chamber is supplied with a fluid, such as air, to press the wafer against the polishing surface of the polishing pad through the membrane under a fluid pressure, and to polish the wafer.

Since the polishing pad has elasticity, the pressing force, applied to a peripheral edge of the wafer during polishing of the wafer, becomes non-uniform, and hence only the peripheral edge of the wafer may excessively be polished, which is referred to as "edge rounding". In order to prevent such edge rounding, a retainer ring for holding the peripheral edge of the wafer is provided so as to press the polishing surface of the polishing pad located at the outer circumferential edge side of the wafer.

A substrate transfer device, which is called a pusher, is disposed near the polishing table. This pusher has a function to elevate the wafer, which has been transported by a transporter, such as a transfer robot, and transfer the wafer to the polishing head that has been moved to a position above the pusher. The pusher further has a function to transfer the wafer, which has been received from the polishing head, to the transporter, such as a transfer robot.

In the polishing apparatus having the above-described structure, the wafer, which has been polished on the polishing surface of the polishing pad, is held on the polishing head via vacuum suction. Further, after the polishing head is elevated together with the wafer, the polishing head is moved to a position above the pusher, and the wafer is then released from the polishing head onto the pusher. Releasing of the wafer is performed by supplying a fluid into the pressure chamber to deform a wafer holding surface of the membrane.

However, if a change in the shape of the membrane is small, the wafer may not be released from the membrane. Thus, in order to ensure releasing of the wafer from the polishing head, the pusher is provided with a release nozzle, as disclosed in Japanese laid-open patent publication No. 2005-123485, Japanese laid-open patent publication No. 2010-46756, and Japanese laid-open patent publication No. 2011-258639. This release nozzle is a mechanism which ejects a jet of fluid (or releasing shower) into a gap between the wafer and the membrane to thereby assist the wafer release.

FIG. 10 is a schematic view showing a wafer releasing operation for releasing a wafer from a membrane. As shown in FIG. 10, a lower surface of a polishing head 100 is constituted by a membrane 104. When a wafer W is transported, the wafer W is held via vacuum suction on a wafer holding surface 104*a* which is constituted by the membrane 104. In FIG. 10, the membrane 104 is inflated so as to release the wafer W therefrom.

A pusher 150 is disposed near the polishing head 100, and the pusher 150 is provided with release nozzles 153 each for ejecting releasing shower. Specifically, the release nozzles 153 are located so as to eject the releasing shower into a gap between the wafer W and the membrane 104. A fluid mixture of pure water and $N_2$ (nitrogen), for example, is used as the releasing shower. The jet of the releasing shower is delivered into the gap between the wafer W and the membrane 104 to thereby release the wafer W from the polishing head 100.

In order to inflate the membrane 104 so as to deform the wafer holding surface 104*a*, a fluid (e.g., nitrogen) having a constant pressure is supplied into the pressure chamber of the membrane 104 for a predetermined time. At this time, if the fluid is excessively supplied into the pressure chamber of the membrane 104, the membrane is largely inflated until the wafer W is brought in contact with the pusher 150, and as a result, the wafer W would be broken. Therefore, the pressure of the fluid, which is supplied into the pressure chamber of the membrane 104, is set to a relatively low pressure (e.g., about 100 hPa) so that an excess amount of the fluid is not supplied into the pressure chamber.

In contrast, if an amount of fluid supplied into the pressure chamber of the membrane 104 is insufficient, the membrane 104 cannot be properly inflated. When the membrane 104 is not properly inflated, the releasing shower does not enter the gap between the wafer W and the membrane 104, but most of the releasing shower impinges on a surface (a surface to be polished) of the wafer W. As a result, the releasing shower presses the wafer W against the membrane 104, thus inhibiting the release of the wafer W. Therefore, in order to perform the inflation of the membrane 104 with a good reproducibility, there is a demand to supply the fluid having a stable pressure into the pressure chamber of the membrane 104.

The fluid, supplied into the pressure chamber of the membrane 104 when releasing the wafer, is introduced into the polishing apparatus through a fluid main pipe 154 extending from a fluid supplying source (e.g., a fluid supply line installed in a factory) 130, as shown in FIG. 10. When the wafer is to be released, the pressure of the fluid, supplied into the pressure chamber of the membrane 104, is regulated by a pressure regulator 156 attached to a fluid supply passage 155 which branches off from the fluid main pipe 154. In the fluid supply passage 155, a valve 138 is located at a secondary side of the pressure regulator 156. When the valve 138 is opened, the fluid having a regulated pressure is supplied into the pressure chamber of the membrane 104.

The pressure of the fluid supplied from the fluid supplying source 130, is typically set to about 0.4 MPa to 0.6 MPa. In contrast, a pressure of the fluid, which is required for inflating the membrane 104, is approximately 100 hPa. Therefore, it is necessary for the pressure regulator 156 to regulate the pressure of the fluid down to about 1/40 to 1/60. However, in the pressure regulator 156 having such a wide regulation range, in many cases, a secondary-side pressure (or a downstream-side pressure) of the pressure regulator 156 would be largely affected by a change in a primary-side pressure (or an upstream-side pressure). More specifically, it is difficult for the pressure regulator 156 to supply the fluid having a stable secondary-pressure under an environment in which the primary-side pressure of the pressure regulator 156 changes.

The releasing shower is ejected from the release nozzles 153 after the pressure chamber of the membrane 104 is inflated. Since the fluid, which serves as the releasing shower, is supplied to the release nozzles 153 through the passage 158 which branches off from the fluid main pipe 154, the primary-side pressure of the pressure regulator 156 changes (i.e., decreases). Further, in order to push out water that has been collected in a gas-water separation tank disposed in a passage for attracting the wafer W, the fluid flowing in a passage 122, which branches off from the fluid main pipe 154, is used. Thus, the primary-side pressure of the pressure regulator 156 changes (i.e., decreases). The secondary-side pressure of the pressure regulator 156 also changes (i.e., decreases) in accordance with the change in the primary-side pressure. As a result, the membrane 104 cannot be properly inflated.

SUMMARY OF THE INVENTION

According to embodiments, there are provided a polishing method and a polishing apparatus which can properly inflate a membrane of a polishing head when a substrate, such as a wafer, is released from the polishing head.

Embodiments, which will be described below, relate to a polishing method and a polishing apparatus, and more particularly to a polishing method and a polishing apparatus of polishing a substrate, such as a wafer.

In an embodiment, there is provided a polishing method comprising: pressing a substrate against a polishing pad on a polishing table by a polishing head, which has a substrate holding surface and a pressure chamber formed by a membrane, while moving the polishing table and the polishing head relative to each other, thereby polishing the substrate; opening a primary-side valve located at a primary side of a fluid storage element communicating with the pressure chamber, while keeping a closed state of a secondary-side valve located at a secondary side of the fluid storage element, thereby storing a fluid, having a pressure adjusted by a pressure regulator, in the fluid storage element; opening the secondary-side valve while the primary-side valve is in a closed state to supply the fluid from the fluid storage element into the pressure chamber, thereby inflating the membrane to form a gap between the substrate and the membrane; and ejecting a releasing shower into the gap, thereby releasing the substrate from the polishing head.

In an embodiment, the primary-side valve is located at a secondary side of the pressure regulator.

In an embodiment, the pressure chamber is one of pressure chambers, the primary-side valve is one of primary-side valves, the secondary-side valve is one of secondary-side valves, the fluid storage element is one of fluid storage elements, and the pressure regulator is one of pressure regulators. Opening of the primary-side valve comprises opening the primary-side valves located at primary sides of the fluid storage elements communicating with the pressure chambers respectively, while keeping a closed state of the secondary-side valves located at secondary sides of the fluid storage elements, thereby storing fluids, having pressures adjusted by the pressure regulators, in the fluid storage elements, respectively, and opening of the secondary-side valve comprises opening the secondary-side valves while the primary-side valves are in a closed state to supply the fluids, which are stored in the fluid storage elements, into the pressure chambers, thereby inflating the membrane to form the gap between the substrate and the membrane.

In an embodiment, the secondary-side valves are opened in a predetermined order while the primary-side valves are in the closed state, thereby supplying the fluids from the fluid storage elements into the pressure chambers in a predetermined order.

In an embodiment, there is provided a polishing method comprising: pressing a substrate against a polishing pad on a polishing table by a polishing head, which has a substrate holding surface and a pressure chamber formed by a membrane, while moving the polishing table and the polishing head relative to each other, thereby polishing the substrate; storing a fluid, having a pressure adjusted by a pressure regulator, in a fluid storage element communicating with the pressure chamber, while keeping a closed state of a secondary-side valve located at a secondary side of the fluid storage element; opening the secondary-side valve to supply the fluid from the fluid storage element into the pressure chamber, thereby inflating the membrane to form a gap between the substrate and the membrane; and ejecting a releasing shower into the gap, thereby releasing the substrate from the polishing head, wherein a passage volume, including the fluid storage element, from the pressure regulator to the secondary-side valve is equal to or greater than a passage volume from the secondary-side valve to the pressure chamber.

In an embodiment, there is provided a polishing apparatus comprising: a polishing table for supporting a polishing pad; a substrate holder having a substrate holding surface and a pressure chamber formed by a membrane, the substrate holder being configured to be able to hold a substrate on the substrate holding surface and press the substrate against the polishing pad by a pressure in the pressure chamber; a fluid supply passage coupled to the pressure chamber; a pressure regulator attached to the fluid supply passage; a fluid storage element attached to the fluid supply passage and located at a secondary side of the pressure regulator; a primary-side valve attached to the fluid supply passage and located at a primary side of the fluid storage element; a secondary-side valve attached to the fluid supply passage and located at a secondary side of the fluid storage element; and a valve controller configured to control opening and closing operations of the primary-side valve and the secondary-side valve, the valve controller being configured to open the primary-side valve while keeping the secondary-side valve in a closed state to store a fluid, having a pressure adjusted by the pressure regulator, in the fluid storage element, and open the secondary-side valve while keeping the primary-side valve in a closed state to supply the fluid from the fluid storage element into the pressure chamber to thereby inflate the membrane.

In an embodiment, the primary-side valve is located at a secondary side of the pressure regulator.

In an embodiment, the pressure chamber is one of pressure chambers, the primary-side valve is one of primary-side valves, the secondary-side valve is one of secondary-side valves, the fluid storage element is one of fluid storage elements, and the pressure regulator is one of pressure regulators, wherein the valve controller is configured to open the primary-side valves while keeping the secondary-side valves in a closed state to store fluids, having pressures adjusted by the pressure regulators, in the fluid storage elements, respectively, and open the secondary-side valves while keeping the primary-side valves in a closed state to thereby supply the fluids from the fluid storage elements into the pressure chambers to inflate the membrane.

In an embodiment, the valve controller is configured to open the secondary-side valves in a predetermined order while the primary-side valves are in the closed state to thereby supply the fluids from the fluid storage elements into the pressure chambers in a predetermined order.

In an embodiment, there is provided a polishing apparatus comprising: a polishing table for supporting a polishing pad; a substrate holder having a substrate holding surface and a pressure chamber formed by a membrane, the substrate holder being configured to be able to hold a substrate on the substrate holding surface and press the substrate against the polishing pad by a pressure in the pressure chamber; a fluid supply passage coupled to the pressure chamber; a pressure regulator attached to the fluid supply passage; a fluid storage element attached to the fluid supply passage and located at a secondary side of the pressure regulator; a secondary-side valve attached to the fluid supply passage and located at a secondary side of the fluid storage element; and a valve controller configured to control opening and closing operations of the secondary-side valve, the valve controller being configured to close the secondary-side valve to store a fluid, having a pressure adjusted by the pressure regulator, in the fluid storage element, and open the secondary-side valve to supply the fluid, which is stored in the fluid storage element, into the pressure chamber to inflate the membrane, wherein a passage volume, including the fluid storage element, from the pressure regulator to the secondary-side valve is equal to or greater than a passage volume from the secondary-side valve to the pressure chamber.

According to the above-described embodiments, the fluid having a desired pressure, which is stored in the fluid storage element, is supplied into the pressure chamber of the membrane. Therefore, even if a primary-side pressure of the pressure regulator changes, the fluid having the adjusted pressure can inflate the membrane with a good reproducibility.

DESCRIPTION OF EMBODIMENTS

Figure 1:
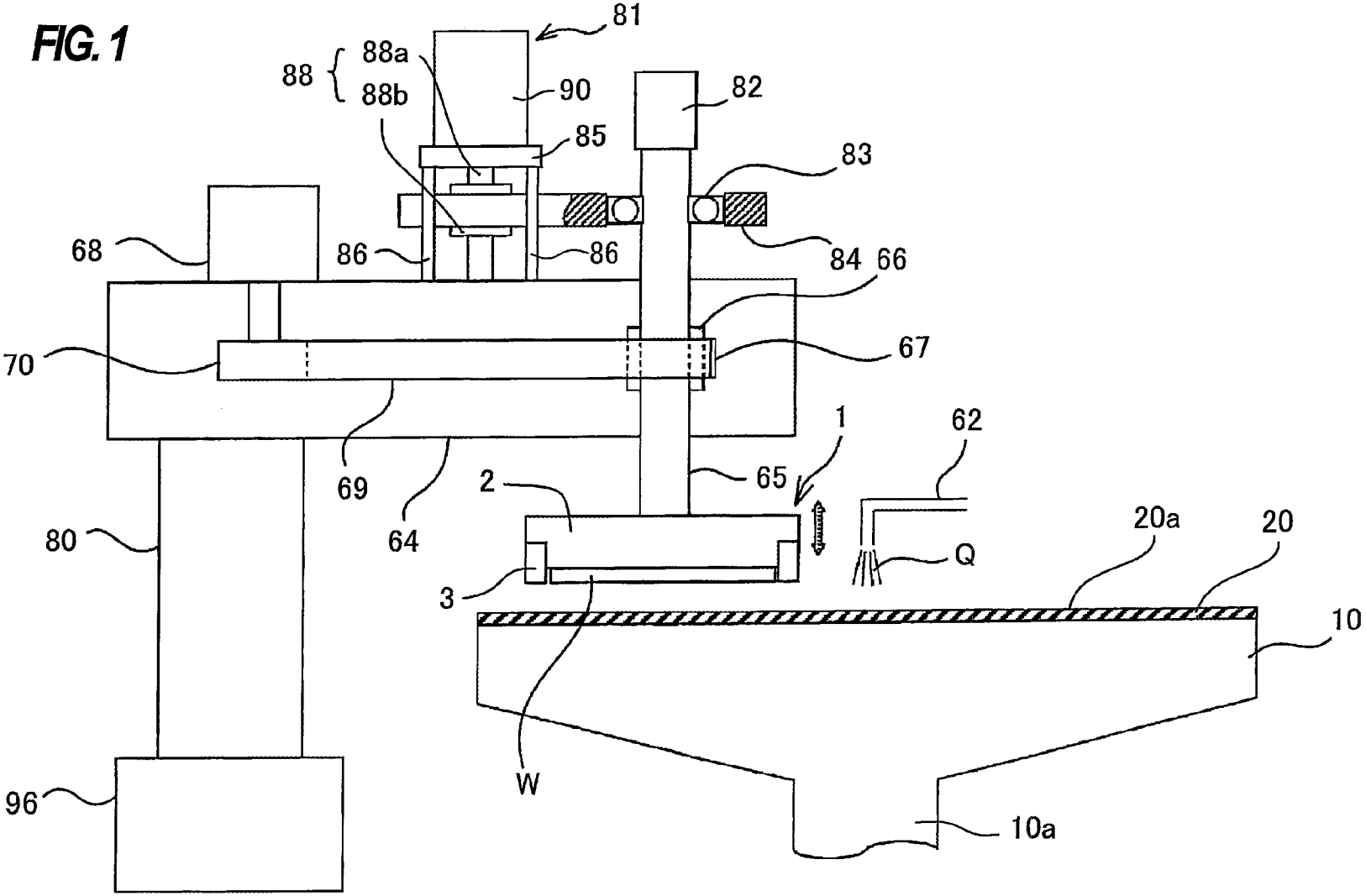
FIG. 1 a schematic view showing an entire structure of a polishing apparatus according to an embodiment.

Embodiments will be described in detail below with reference to FIGS. 1 through 9. Identical or corresponding structural elements are denoted by the same reference numerals in FIGS. 1 through 9 and repetitive explanations thereof will be omitted.

FIG. 1 is a schematic view showing an entire structure of a polishing apparatus according to an embodiment. As shown in FIG. 1, the polishing apparatus includes a polishing table 10 for supporting a polishing pad 20, and a polishing head (or a substrate holder) 1 for holding a wafer W, which is an example of a substrate, and pressing the wafer W against the polishing pad 20 on the polishing table 10.

The polishing table 10 is coupled via a table shaft 10*a* to a motor (not shown) disposed below the polishing table 10, so that the polishing table 10 is rotatable about the table shaft 10*a*. The polishing pad 20 is attached to an upper surface of the polishing table 10, and a surface 20*a* of the polishing pad 20 serves as a polishing surface for polishing the wafer W. A polishing-liquid supply nozzle 62 is provided above the polishing table 10 so that a polishing liquid Q is supplied from the polishing-liquid supply nozzle 62 onto the polishing pad 20.

The polishing head 1 is basically constituted by a head body 2 for pressing the wafer W against the polishing surface 20*a*, and a retainer ring 3 for retaining the wafer W so as to prevent the wafer W from being ejected from the polishing head 1.

The polishing head 1 is coupled to a polishing head shaft 65, which can be moved in a vertical direction relative to a polishing head arm 64 by a vertically moving mechanism 81. This vertical movement of the polishing head shaft 65 enables the entirety of the polishing head 1 to move upward and downward and enables positioning of the polishing head 1 with respect to the polishing head arm 64. A rotary joint 82 is mounted to an upper end of the polishing head shaft 65.

The vertically moving mechanism 81 for moving the polishing head shaft 65 and the polishing head 1 in the vertical direction includes a bridge 84 for rotatably supporting the polishing head shaft 65 through a bearing 83, a ball screw 88 mounted to the bridge 84, a support pedestal 85 supported by support posts 86, and a servomotor 90 mounted on the support pedestal 85. The support pedestal 85, which supports the servomotor 90, is fixedly mounted to the polishing head arm 64 through the support posts 86.

The ball screw 88 includes a screw shaft 88*a* coupled to the servomotor 90 and a nut 88*b* that engages with this screw shaft 88*a*. The polishing head shaft 65 is movable together with the bridge 84 in the vertical direction. Therefore, when the servomotor 90 is set in motion, the bridge 84 moves through the ball screw 88 in the vertical direction, so that the polishing head shaft 65 and the polishing head 1 move in the vertical direction.

Further, the polishing head shaft 65 is coupled to a rotary sleeve 66 by a key (not shown). A timing pulley 67 is secured to a circumferential surface of this rotary sleeve 66. A polishing-head rotating motor 68 is fixed to the polishing head arm 64, and the timing pulley 67 is coupled to a timing pulley 70, mounted to the polishing-head rotating motor 68, through a timing belt 69. Therefore, when the polishing-head rotating motor 68 is set in motion, the rotary sleeve 66 and the polishing head shaft 65 are rotated in unison with each other through the timing pulley 70, the timing belt 69, and the timing pulley 67, thus rotating the polishing head 1. The polishing head arm 64 is supported by an arm shaft 80, which is rotatably supported by a frame (not shown). The polishing apparatus further includes a controller (not shown) for controlling devices including the polishing-head rotating motor 68 and the servomotor 90.

The polishing head 1 is configured to be able to hold the wafer W on its lower surface via vacuum suction. An arm shaft 80 is coupled to an arm motor 96, and the polishing head arm 64 is configured to be able to pivot on the arm shaft 80 by this arm motor 96. Thus, the polishing head 1, which holds the wafer W on its lower surface, is moved between a position above a substrate transfer device (which will be discussed later) and a position above the polishing table 10 by a pivotal movement of the polishing head arm 64. In this embodiment, a polishing-head moving mechanism for moving the polishing head 1 is constructed by the arm shaft 80, the arm motor 96, and the polishing head arm 64.

Polishing of the wafer W is performed as follows. The polishing head 1 and the polishing table 10 are rotated individually, while the polishing liquid Q is supplied onto the polishing pad 20 from the polishing-liquid supply nozzle 62 provided above the polishing table 10. In this state, the polishing head 1 presses the wafer W against the polishing surface 20*a* of the polishing pad 20 so that the wafer W is placed in sliding contact with the polishing surface 20*a* of the polishing pad 20. A surface of the wafer W is polished by the polishing pad 20 in the presence of the polishing liquid Q.

Figure 2:
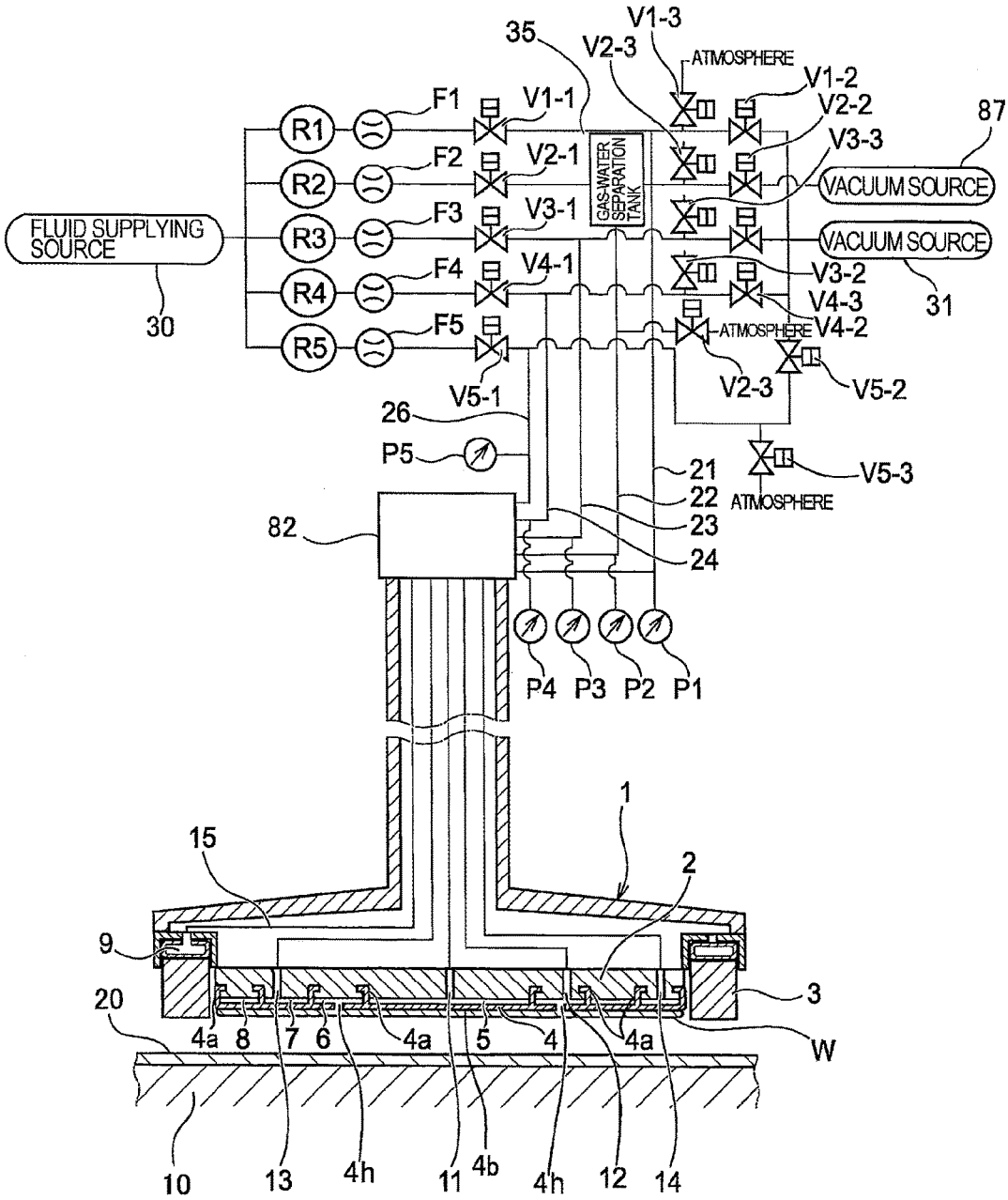
FIG. 2 is a schematic cross-sectional view of a polishing head for holding a wafer and pressing the wafer against a polishing pad on a polishing table.

Next, the polishing head 1 will be described. FIG. 2 is a schematic cross-sectional view showing the polishing head 1 for holding the wafer W, which is an object to be polished, and pressing the wafer W against the polishing pad 20 on the polishing table 10.

As shown in FIG. 2, the polishing head 1 includes a membrane (or flexible membrane) 4 for pressing the wafer W against the polishing pad 20, the head body 2 (which is also referred to as a carrier) holding the membrane 4, and the retainer ring 3 for directly pressing the polishing pad 20. The head body 2 is in approximately a disk shape. The retainer ring 3 is attached to a peripheral portion of the head body 2. The head body 2 is formed of resin, such as engineering plastic (e.g., PEEK). The membrane 4, which is brought into contact with a rear surface of the wafer W, is attached to a lower surface of the head body 2. The membrane 4 is formed of a highly strong and durable rubber material, such as ethylene propylene rubber (EPDM), polyurethane rubber, silicone rubber, or the like.

The membrane 4 has a plurality of concentric partition walls 4*a* defining multiple pressure chambers, which are a circular central chamber 5, an annular ripple chamber 6, an annular outer chamber 7, and an annular edge chamber 8. These pressure chambers are located between an upper surface of the membrane 4 and a lower surface of the head body 2. The central chamber 5 is formed at the central portion of the head body 2, and the ripple chamber 6, the outer chamber 7, and the edge chamber 8 are concentrically arranged in the order from the central portion to the peripheral portion of the head body 2.

The wafer W is held on a wafer holding surface (a substrate holding surface) 4*b* which is formed by the membrane 4. The membrane 4 has a plurality of holes 4*h* for wafer suction located in positions corresponding to the position of the ripple chamber 6. While the holes 4*h* are located in the corresponding position of the ripple chamber 6 in this embodiment, the holes 4*h* may be located in positions of other pressure chamber. A passage 11 communicating with the central chamber 5, a passage 12 communicating with the ripple chamber 6, a passage 13 communicating with the outer chamber 7, and a passage 14 communicating with the edge chamber 8 are formed in the head body 2. The passages 11, 13, and 14 are coupled via the rotary joint 82 to passages 21, 23, and 24, respectively. These passages 21, 23, and 24 are coupled to a fluid supplying source 30 via respective valves V1-1, V3-1, and V4-1 and respective pressure regulators R1, R3, and R4. The passages 21, 23, and 24 are coupled to a vacuum source 31 through valves V1-2, V3-2, and V4-2, respectively, and further communicate with the atmosphere through valves V1-3, V3-3, and V4-3, respectively. The fluid supplying source 30 is, for example, a fluid supply line provided in a facility in which the polishing apparatus is installed. For example, nitrogen or air having a pressure of about 0.4 Mpa to 0.6 Mpa flows in this fluid supply line 30.

The passage 12 communicating with the ripple chamber 6 is coupled to a passage 22 via the rotary joint 82. The passage 22 is coupled to the fluid supplying source 30 via a gas-water separation tank 35, a valve V2-1, and a pressure regulator R2. Further, the passage 22 is coupled to a vacuum source 87 via the gas-water separation tank 35 and a valve V2-2, and further communicates with the atmosphere via a valve V2-3.

A retainer-ring pressure chamber 9, which is in an annular shape and is formed of a flexible membrane, is provided right above the retainer ring 3. This retainer-ring pressure chamber 9 is coupled to a passage 26 via a passage 15 formed in the head body 2 and the rotary joint 82. The passage 26 is coupled to the fluid supplying source 30 via a valve V5-1 and a pressure regulator R5. Further, the passage 26 is coupled to the vacuum source 31 via a valve V5-2, and communicates with the atmosphere via a valve V5-3.

Each of the pressure regulators R1, R2, R3, R4, and R5 has a pressure regulating function to regulate pressures of the fluid (e.g., a gas, such as air or nitrogen) supplied from the fluid supplying source 30 to the central chamber 5, the ripple chamber 6, the outer chamber 7, the edge chamber 8, and the retainer-ring pressure chamber 9, respectively. The pressure regulators R1, R2, R3, R4, and R5 and the valves V1-1 to V1-3, V2-1 to V2-3, V3-1 to V3-3, V4-1 to V4-3, and V5-1 to V5-3 are coupled to the controller which is not illustrated, so that operations of these pressure regulators and these valves are controlled by the controller.

Pressure sensors P1, P2, P3, P4, and P5 and flow-rate sensors F1, F2, F3, F4, and F5 are provided in the passages 21, 22, 23, 24, and 26, respectively. The pressures in the central chamber 5, the ripple chamber 6, the outer chamber 7, the edge chamber 8, and the retainer-ring pressure chamber 9 are measured by the presser sensors P1, P2, P3, P4, and P5, respectively. Flow rates of the pressurized fluid supplied to the central chamber 5, the ripple chamber 6, the outer chamber 7, the edge chamber 8, and the retainer-ring pressure chamber 9 are measured by the flow-rate sensors F1, F2, F3, F4, and F5, respectively.

The pressures of the fluid supplied to the central chamber 5, the ripple chamber 6, the outer chamber 7, the edge chamber 8, and the retainer-ring pressure chamber 9 can be independently controlled by the pressure regulators R1, R2, R3, R4, and R5. With this structure, forces of pressing the wafer W against the polishing pad 20 can be adjusted at respective local areas of the wafer, while a force of pressing the polishing pad 20 by the retainer ring 3 can be adjusted.

Next, a sequence of polishing operations of the polishing apparatus constructed as shown in FIG. 1 and FIG. 2 will be described. The polishing head 1 receives the wafer W from a pusher (which will be described later) and holds the wafer W thereon by the vacuum suction. Holding of the wafer W via the vacuum suction is achieved by producing a vacuum in the plurality of holes 4*h* by the vacuum source 87.

The polishing head 1, holding the wafer W, is lowered to a preset polishing position. At this polishing position, the retainer ring 3 is brought into contact with the polishing surface 20*a* of the polishing pad 20, while a small gap (e.g., about 1 mm) is formed between a lower surface (a surface to be polished) of the wafer W and the polishing surface 20*a* of the polishing pad 20, because the wafer W is held on the polishing head 1 before the wafer W is polished. At this time, both the polishing table 10 and the polishing head 1 are being rotated. In this state, the pressurized fluid is supplied into the central chamber 5, the ripple chamber 6, the outer chamber 7, and the edge chamber 8, which are provided behind the wafer W, to inflate the membrane 4, thereby bringing the lower surface of the wafer W into contact with the polishing surface 20*a* of the polishing pad 20. The polishing pad 20 and the wafer W are moved relative to each other, so that the surface of the wafer W is polished.

After polishing of the wafer W is terminated, the wafer W is held by the polishing head 1 again. The polishing head 1, holding the wafer W, is elevated by the vertically moving mechanism 81, and is further moved to a predetermined position above the pusher by the pivotal movement of the polishing head arm 64. At this predetermined position, the wafer W is released from the polishing head 1 and transferred to the pusher.

Figure 3:
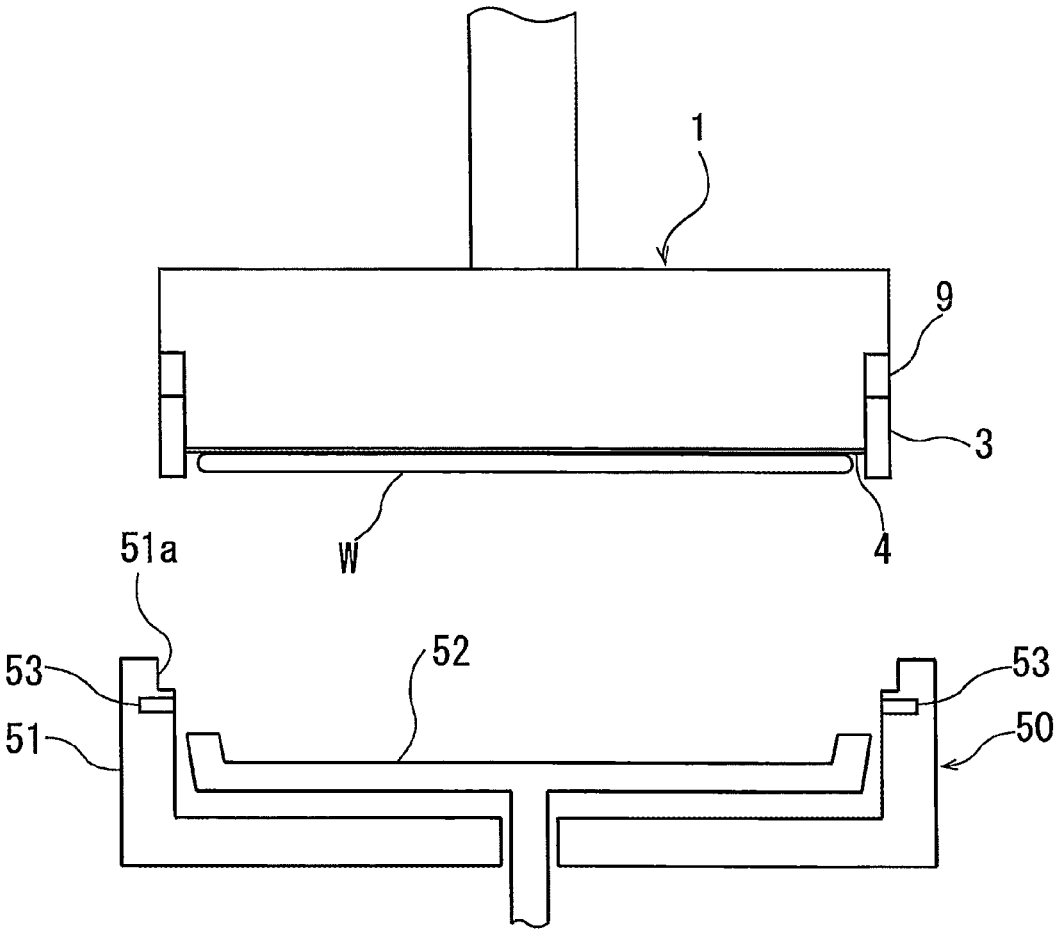
FIG. 3 is a schematic view showing a state in which the polishing head has just been moved to a predetermined position above a pusher in order to transfer the wafer to the pusher.
Figure 4:
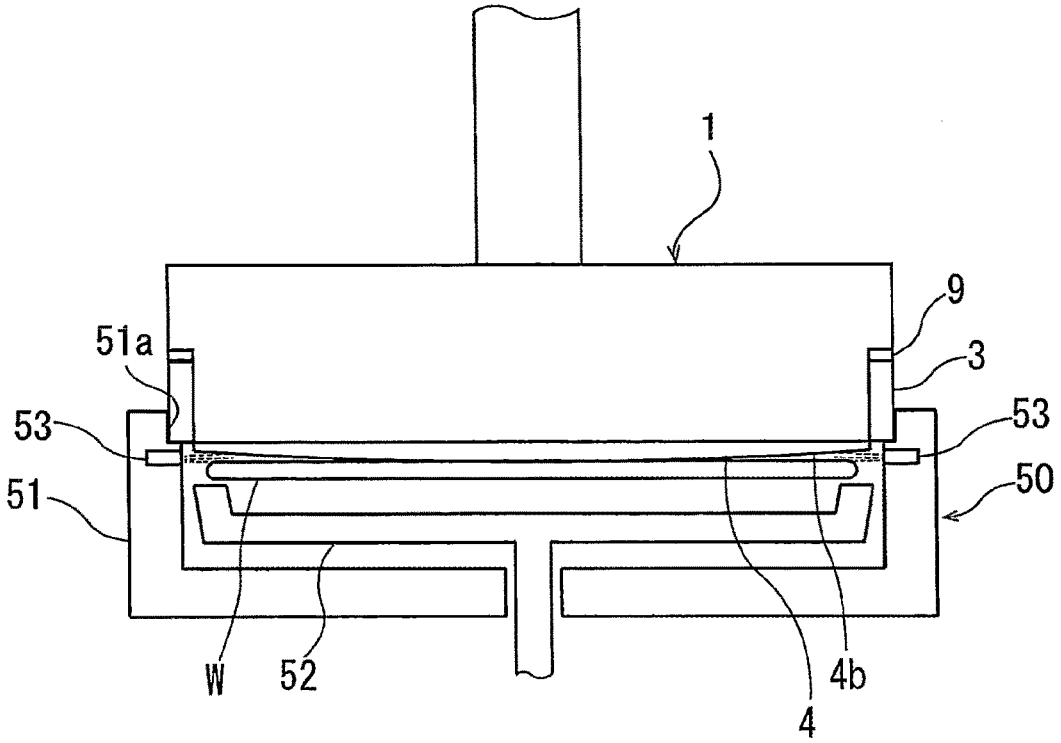
FIG. 4 is a schematic view showing a state in which the pusher is elevated in order to transfer the wafer from the polishing head to the pusher.

FIG. 3 is a schematic view showing a state in which the polishing head 1 has just been moved to the predetermined position above the pusher 50 in order to transfer the wafer W to the pusher 50. FIG. 4 is a schematic view showing a state in which the pusher 50 is elevated in order for the polishing head 1 to transfer the wafer W to the pusher 50. The pusher 50 is a wafer transfer device (or a substrate transfer device) configured to transfer the wafer W between the polishing head 1 and a transporter (not shown). This pusher 50 is located beside the polishing table 10. The wafer W is moved to the predetermined position above the pusher 50 while the polishing head 1 keeps holding the wafer thereon.

As shown in FIG. 3 and FIG. 4, the pusher 50 includes a polishing-head guide 51 having an annular step 51*a* into which an outer peripheral surface of the retainer ring 3 can be fitted for achieving positioning the polishing head 1, a pusher stage 52 for supporting the wafer W when the wafer W is transferred between the polishing head 1 and the pusher 50, an air cylinder (not shown) for moving the pusher stage 52 in the vertical direction, and an air cylinder (not shown) for moving the pusher stage 52 and the polishing-head guide 51 in the vertical direction.

The pusher 50 is provided with release nozzles 53, which are formed in the polishing-head guide 51, for ejecting a fluid (or a releasing shower). The release nozzles 53 are arranged at predetermined intervals along a circumferential direction of the polishing-head guide 51. Each release nozzle 53 is configured to eject the releasing shower, which is constituted by a mixture of pressurized nitrogen and pure water, in a radially inward direction of the polishing-head guide 51.

Next, a wafer releasing operation (or a substrate releasing operation) for transferring the wafer W from the polishing head 1 to the pusher 50 will be described. After the polishing head 1 is moved to the predetermined position above the pusher 50, the pusher 50 is elevated as shown in FIG. 4 until the outer peripheral surface of the retainer ring 3 is fitted into the annular step 51*a* of the polishing-head guide 51, so that the polishing head 1 is aligned with the pusher 50. At this time, the polishing-head guide 51 pushes the retainer ring 3 upwardly, and at the same time, the vacuum is produced in the retainer-ring pressure chamber 9, thereby elevating the retainer ring 3 rapidly.

When elevating of the pusher 50 is completed, the wafer W and the membrane 4 are exposed, because a bottom surface of the retainer ring 3 is pushed upwardly to a position higher than a lower surface of the membrane 4. Thereafter, vacuum-chucking of the wafer W by the polishing head 1 is stopped, and a wafer releasing operation is performed. Instead of elevating the pusher 50, the polishing head 1 may be lowered to come into contact with the pusher 50.

When the wafer releasing operation is performed, the pressure chamber (e.g., the ripple chamber 6) of the membrane 4 is pressurized at a low pressure (e.g., about 100 hPa) to inflate the membrane 4. As a result, a gap is formed between the peripheral edge of the wafer W and the membrane 4. The releasing shower, comprising the fluid mixture of pressurized nitrogen and pure water, is then ejected into this gap from the release nozzles 53, thereby releasing the wafer W from the membrane 4. The wafer W is received by the pusher stage 52, and is then transferred from the pusher stage 52 to the transporter, such as a transfer robot. While the fluid mixture of the pressurized nitrogen and the pure water is used as the releasing shower in this embodiment, the releasing shower may be constituted by only a pressurized gas or only a pressurized liquid, or may be constituted by a pressurized fluid of other combination.

Figure 5:
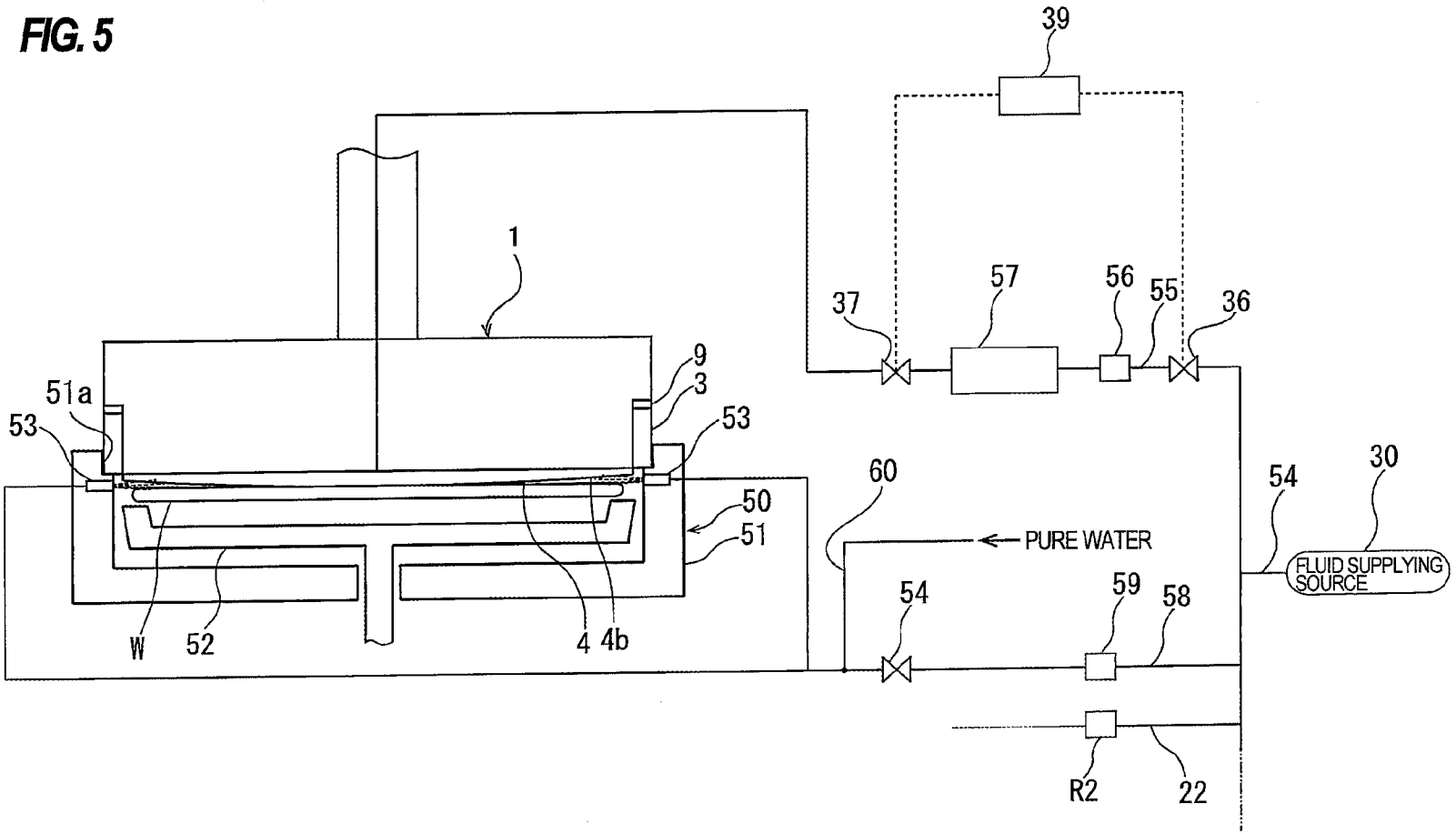
FIG. 5 is a schematic view showing a fluid supplying system installed in the polishing apparatus.

FIG. 5 is a schematic view showing a fluid supplying system installed in the polishing apparatus. As shown in FIG. 5, in order to supply the fluid into the pressure chamber (e.g., the ripple chamber 6 shown in FIG. 2) of the polishing head 1 when the wafer releasing operation is performed, a fluid supply passage 55, which is coupled to that pressure chamber, is provided. The fluid supply passage 55 branches off from a fluid main pipe 54 which is coupled to the fluid supplying source (e.g., a fluid supplying line installed in a factory) 30. The passages 21, 22, 23, 24, and 26, shown in FIG. 2, also branch off from the fluid main pipe 54. The fluid supply passage 55 is provided independently of these passages 21, 22, 23, 24, and 26.

FIG. 5 further shows, as examples of the passage which branches off from the fluid main pipe 54, the passage 22 on which the gas-water separation tank 35 shown in FIG. 2 is disposed, and the passage 58 which is coupled to the release nozzles 53. A pressure regulator 59 is attached to the passage 58. This pressure regulator 59 can regulate a pressure of the fluid, which is supplied from the fluid supplying source 30, to a desired pressure. The pressure adjusted by the pressure regulator 59 is, for example, 0.3 MPa. A pure-water supply passage 60 is coupled to the passage 58. A valve 54 is located at a secondary side of the pressure regulator 59. When the valve 54 is opened, the fluid, which serves as the releasing shower, is ejected from the release nozzles 53.

A pressure regulator 56 is attached to the fluid supply passage 55. This pressure regulator 56 can regulate a pressure of the fluid, which is supplied from the fluid supplying source 30, to a desired pressure. The desired pressure, which is adjusted by the pressure regulator 56, is 100 hPa, for example. A fluid storage element 57 is disported at a secondary side of the pressure regulator 56. The fluid storage element 57 is, for example, a buffer tank, which can store the fluid, having a pressure adjusted by the pressure regulator 56, therein.

A primary-side valve 36 is located at a primary side (or an upstream side) of the fluid storage element 57, and a secondary-side valve 37 is located at a secondary side (or a downstream side) of the fluid storage element 57. The primary-side valve 36 is located at a primary side of the pressure regulator 56. The primary-side valve 36 and the secondary-side valve 37 are coupled to a valve controller 39. The valve controller 39 is configured to control opening and closing operations of the primary-side valve 36 and the secondary-side valve 37.

The valve controller 39 is configured to close the secondary-side valve 37 and open the primary-side valve 36 at predetermined timings before the wafer releasing operation is performed. Consequently, the fluid, having a desired pressure adjusted by the pressure regulator 56, is stored in the fluid storage element 57. When the wafer is to be released, the valve controller 39 closes the primary-side valve 36, and opens the secondary-side valve 37. Consequently, the fluid stored in the fluid storage element 57 is supplied into the pressure chamber of the polishing head 1, so that the membrane 4 can be inflated.

The predetermined timings, at which the valve controller 39 closes the secondary-side valve 37 and opens the primary-side valve 36, are preferably timings at which a primary-side pressure of the pressure regulator 56 is stable. More specifically, the valve controller 39 closes the secondary-side valve 37 and opens the primary-side valve 36 when the fluid does not flow, or only a small amount of fluid flows in the passages 21, 22, 23, 24, 26, and 58. The primary-side valve 36 may be closed after the fluid is stored in the fluid storage element 57. In this case, during the wafer releasing operation, the valve controller 39 opens the secondary-side valve 37 while keeping the primary-side valve 36 closed. The primary-side valve 36 may be kept open after the fluid is stored in the fluid storage element 57 until just before the wafer releasing operation is started.

The fluid, adjusted by the pressure regulator 56 to have a desired pressure, is stored in the fluid storage element 57. When the fluid is supplied into the pressure chamber of the polishing head 1, a communication between the secondary side of the primary-side valve 36 and other passages (e.g., passages 22 and 58), which extend from the fluid supplying source 30, is cut off, because the primary-side valve 36 is closed. Therefore, even if the primary-side pressure of the primary-side valve 36 changes, the fluid having a stable pressure can be supplied from the fluid storage element 57 into the pressure chamber of the polishing head 1. As a result, the membrane 4 can be inflated with a good reproducibility at all times, thereby making it possible to form a proper gap between the wafer W and the membrane 4. Therefore, the releasing shower can be properly supplied into this gap, thereby reliably releasing the wafer W.

Since the primary-side valve 36 is in a closed state when the fluid is supplied into the pressure chamber of the polishing head 1 in the wafer releasing operation, the fluid is not supplied from the fluid supplying source 30 to the secondary side of the primary-side valve 36. In this state, as the fluid is supplied from the fluid storage element 57 into the pressure chamber of the polishing head 1, the secondary-side pressure of the primary-side valve 36 is slightly lowered. For example, if a set value of the secondary-side pressure of the pressure regulator 56 is 100 hPa in a case where a pressure required for inflating the membrane 4 is 100 hPa, an actual pressure in the pressure chamber when inflating the membrane 4 becomes slightly lower than 100 hPa. Thus, the set value of the secondary-side pressure of the pressure regulator 56 is preferably slightly larger than the pressure required for inflating the membrane 4. For example, the set value of the secondary-side pressure of the pressure regulator 56 is such that the secondary-side pressure of the pressure regulator 56 is equal to a pressure required for inflating the membrane 4 when the primary-side valve 36 is closed and the secondary-side valve 37 is opened (i.e., when the fluid is supplied into the pressure chamber).

As shown in FIG. 5, since the primary-side valve 36 is located at the primary side of the pressure regulator 56, the secondary-side pressure of the pressure regulator 56 can be measured by a pressure sensor or a pressure gauge (not shown) which is incorporated in the pressure regulator 56. Therefore, the pressure of the fluid, which is supplied into the pressure chamber in order to inflate the membrane 4 with the primary-side valve 36 closed, can be measured. Further, the above-described set value of the secondary-side pressure of the pressure regulator 56 can be adjusted while measuring the actual pressure of the fluid supplied into the pressure chamber.

Figure 6:
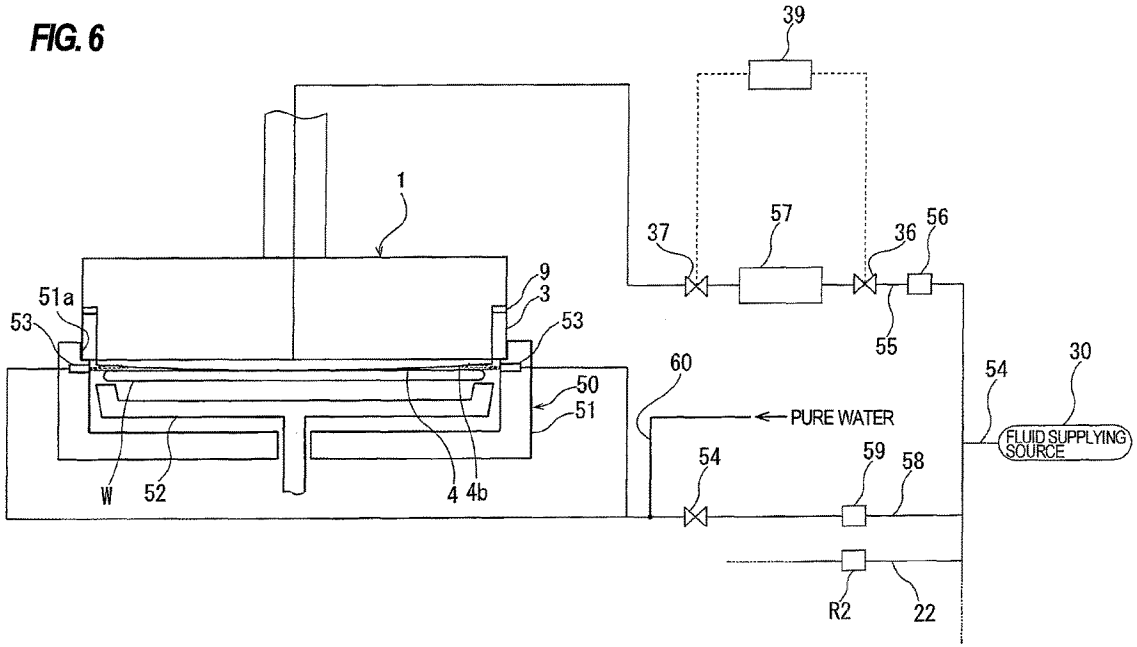
FIG. 6 is a schematic view illustrating another embodiment of the fluid supplying system shown in FIG. 5.

FIG. 6 is a schematic view illustrating another embodiment of the fluid supplying system shown in FIG. 5. In the fluid supplying system shown in FIG. 6, the primary-side valve 36 is located at the secondary side (or the downstream side) of the pressure regulator 56. Other structures in this embodiment are the same as those of the embodiment shown in FIG. 5. Therefore, the corresponding elements are denoted by identical reference numerals, and detailed descriptions thereof are omitted.

As shown in FIG. 6, since the primary-side valve 36 is located at the secondary side of the pressure regulator 56, the pressure of the fluid, supplied from the fluid storage element 57 into the pressure chamber of the polishing head 1, is not affected by a fluctuation of the pressure due to the operation of the pressure regulator 56. Therefore, the fluid having a more stable pressure can be supplied into the pressure chamber of the polishing head 1.

Figure 7:
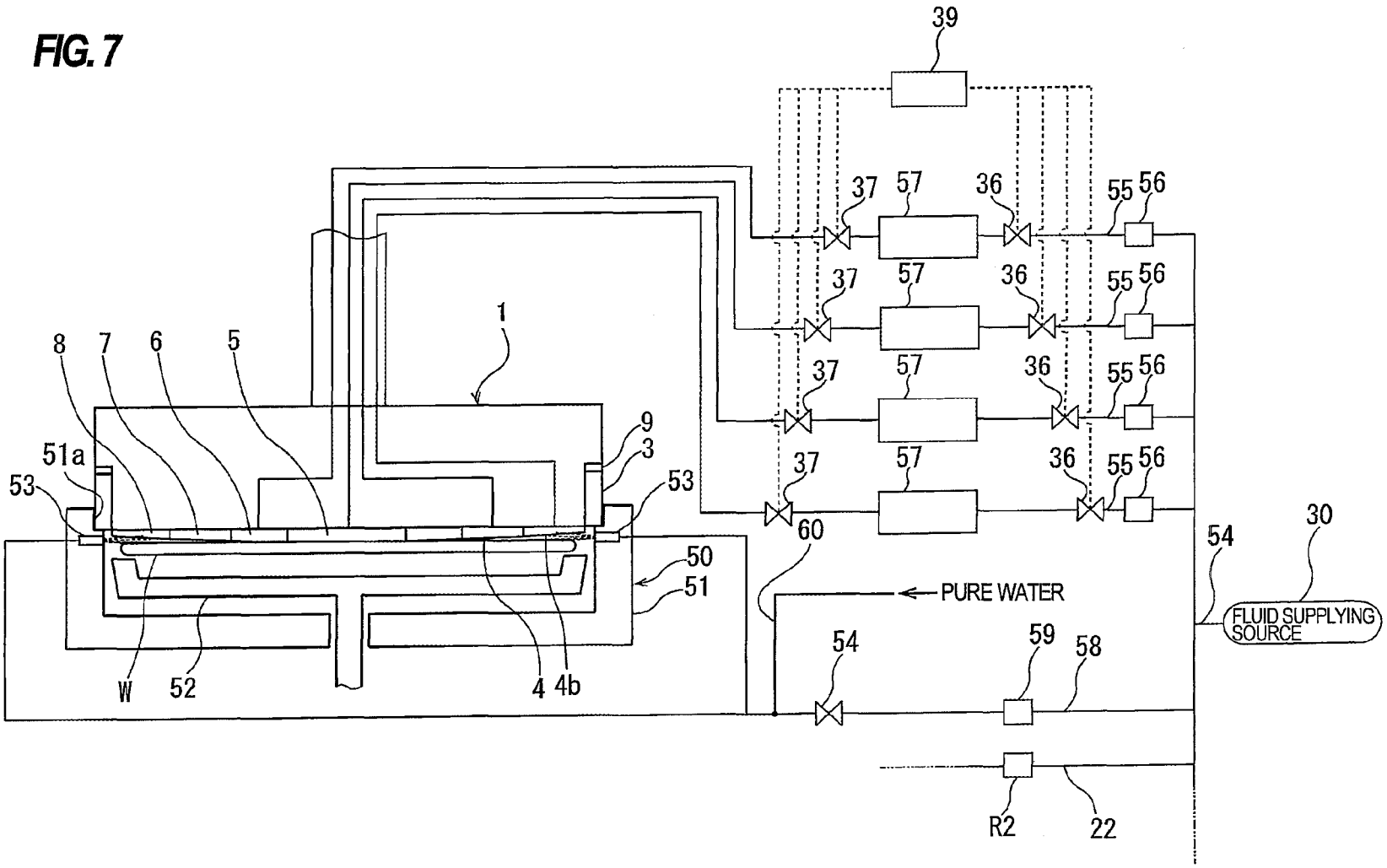
FIG. 7 is a schematic view illustrating an embodiment of a fluid supplying system including a plurality of fluid supply passages.

FIG. 7 is a schematic view illustrating an embodiment of a fluid supplying system including a plurality of fluid supply passages. In the embodiment shown in FIG. 7, a plurality of fluid supply passages 55 are coupled to the plurality of pressure chambers (i.e., the central chamber 5, the ripple chamber 6, the outer chamber 7, and the edge chamber 8) of the polishing head 1, respectively.

Each of the fluid supply passages 55 is provided with the primary-side valve 36, the secondary-side valve 37, the pressure regulator 56, and the fluid storage element 57. An arrangement of the primary-side valve 36, the secondary-side valve 37, the pressure regulator 56, and the fluid storage element 57 is identical to an arrangement of those shown in FIG. 6. More specifically, the primary-side valve 36 is located at the primary side (or the upstream side) of the fluid storage element 57 and at the secondary side (or the downstream side) of the pressure regulator 56. The secondary-side valve 37 is located at the secondary side of the fluid storage element 57. The primary-side valve 36 may be located at the primary side of the pressure regulator 56 as in the embodiment shown in FIG. 5. Regardless of whether the primary-side valve 36 is located at the primary side or the secondary side of the pressure regulator 56, the fluids having stable pressures can be supplied into the pressure chambers (i.e., the central chamber 5, the ripple chamber 6, the outer chamber 7, and the edge chamber 8) of the polishing head 1, respectively, as discussed above.

All of the primary-side valves 36 and all of the secondary-side valves 37 are coupled to the valve controller 39. The valve controller 39 is configured to close the secondary-side valves 37 and open the primary-side valves 36 at predetermined timings before the wafer releasing operation is performed. Consequently, the fluids, having desired pressures adjusted by the pressure regulators 56, are stored in the plurality of fluid storage elements 57, respectively. The valve controller 39 closes the primary-side valves 36 and opens the secondary-side valves 37 when releasing the wafer. Consequently, the fluids stored in the plurality of fluid storage elements 57 are supplied into the pressure chambers of the polishing head 1, respectively, thereby inflating the membrane 4.

The fluids, having desired pressures adjusted by the pressure regulators 56, are stored in the fluid storage elements 57, respectively. When the fluids are supplied into the pressure chambers of the polishing head 1, all of the primary-side valves 36 are closed. Therefore, communications between the secondary sides of the primary-side valves 36 and other passages (e.g., the passages 22 and 58), which extend from the fluid supplying source 30, are cut off. Therefore, even if the primary-side pressures of the primary-side valves 36 change, the fluids having stable pressures can be supplied from the plurality of fluid storage elements 57 into the pressure chambers of the polishing head 1, respectively. As a result, the membrane 4 can be inflated with a good reproducibility at all times, thereby making it possible to form a proper gap between the wafer W and the membrane 4. Therefore, the releasing shower can be properly supplied into this gap, thereby reliably releasing the wafer W.

When the wafer releasing operation is performed, the valve controller 39 may simultaneously open all of the secondary-side valves 37, with all of the primary-side valves 36 in the closed state. Alternatively, the valve controller 39 may open the secondary-side valves 37 in a predetermined order, with all of the primary-side valves 36 in the closed state. For example, the secondary-side valve 37, which is attached to the fluid supply passage 55 coupled to the central chamber 5, may be first opened, and then the secondary-side valves 37, which are attached to the fluid supply passages 55 coupled to the ripple chamber 6, the outer chamber 7, and the edge chamber 8, may be opened in this order. In this case, the membrane 4 is inflated gradually from a central portion of the membrane 4. Alternatively, the secondary-side valve 37, which is attached to the fluid supply passage 55 coupled to the edge chamber 8, may be first opened, and then the secondary-side valves 37, which are attached to the fluid supply passages 55 coupled to the outer chamber 7, the ripple chamber 6, and the central chamber 5, may be opened in this order. In this case, the membrane 4 is inflated gradually from a peripheral portion of the membrane 4.

The valve controller 39 controls the timings at which the secondary-side valves 37 are opened. The valve controller 39 opens the secondary-side valves 37 at predetermined timings in a predetermined order to inflate the membrane 4. In this embodiment, since the valve controller 39 controls the order in which the secondary-side valves 37 are opened, a stress, generated in the wafer W when the wafer W is released from the membrane 4, can be decreased.

The secondary-side pressures adjusted by the pressure regulators 56 attached to the fluid supply passages 55, which are coupled to the central chamber 5, the ripple chamber 6, the outer chamber 7, and the edge chamber 8, respectively, can be set to different pressures. Consequently, a more detailed control on the inflation of the membrane 4 can be achieved, and therefore the proper gap can be formed between the wafer W and the membrane 4. The fluids having the different pressures may be supplied into the central chamber 5, the ripple chamber 6, the outer chamber 7, and the edge chamber 8 at the same time.

Figure 8:
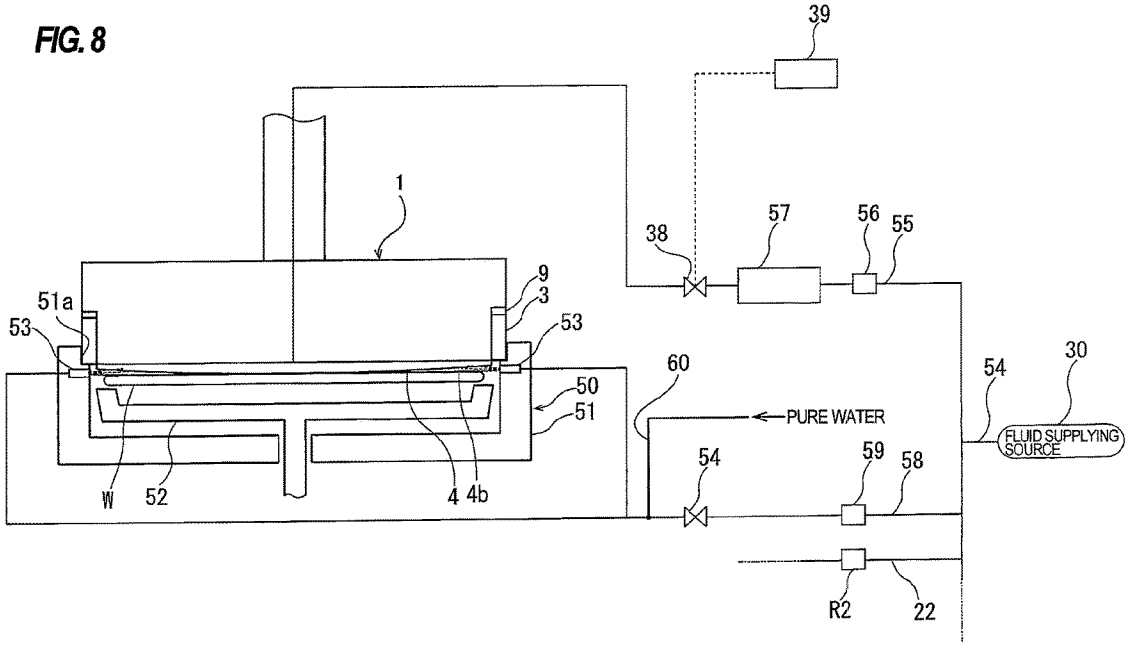
FIG. 8 is a schematic view illustrating still another embodiment of the fluid supplying system.

FIG. 8 is a schematic view illustrating still another embodiment of the fluid supplying system. The pressure regulator 56 is attached to the fluid supply passage 55. This pressure regulator 56 is configured to be able to regulate the pressure of the fluid, which is supplied from the fluid supplying source 30, to a desired pressure. The fluid storage element 57 is located at the secondary side of the pressure regulator 56. The fluid storage element 57 is, for example, a buffer tank, which can store the fluid, having a pressure adjusted by the pressure regulator 56, therein.

A secondary-side valve 38 is located at the secondary side of the fluid storage element 57. The secondary-side valve 38 is coupled to the valve controller 39, which is configured to control opening and closing operations of the secondary-side valve 38. In this embodiment, the primary-side valve is not provided at the primary side of the fluid storage element 57.

In this embodiment, the fluid supply passage 55 is configured such that a passage volume from the pressure regulator 56 to the secondary-side valve 38 is equal to or greater than a passage volume from the secondary-side valve 38 to the pressure chamber of the polishing head 1. The passage volume from the pressure regulator 56 to the secondary-side valve 38 is preferably at least twice the passage volume from the secondary-side valve 38 to the pressure chamber of the polishing head 1. The passage volume from the pressure regulator 56 to the secondary-side valve 38 includes an interior volume of the fluid storage element 57, and further includes an interior volume of the fluid supply passage 55. Similarly, the passage volume from the secondary-side valve 38 to the pressure chamber of the polishing head 1 includes an interior volume of the fluid supply passage 55.

The secondary-side valve 38 is closed by the valve controller 39 before the wafer releasing operation is performed. Consequently, the fluid, having a desired pressure adjusted by the pressure regulator 56, is stored in the fluid storage element 57. When the wafer releasing operation is performed, the valve controller 39 opens the secondary-side valve 38. Consequently, the fluid is supplied into the pressure chamber of the polishing head 1, thereby inflating the membrane 4.

The fluid, having a desired pressure adjusted by the pressure regulator 56, is stored in a passage including the fluid storage element 57 and extending from the pressure regulator 56 to the secondary-side valve 38. This passage volume from the pressure regulator 56 to the secondary-side valve 38 is equal to or greater than the passage volume from the secondary-side valve 38 to the pressure chamber of the polishing head 1. The amount of the fluid, stored in the passage extending from the pressure regulator 56 to the secondary-side valve 38, is such that the fluid having a desired pressure can be supplied into the pressure chamber of the polishing head 1. Therefore, even if the primary-side pressure of the pressure regulator 56 changes, the fluid having a stable pressure can be supplied from the fluid storage element 57 into the pressure chamber of the polishing head 1. As a result, the membrane 4 can be inflated with a good reproducibility at all times, thereby making it possible to form a proper gap between the wafer W and the membrane 4. Therefore, the releasing shower is properly supplied into this gap, thereby reliably releasing the wafer W.

Figure 9:
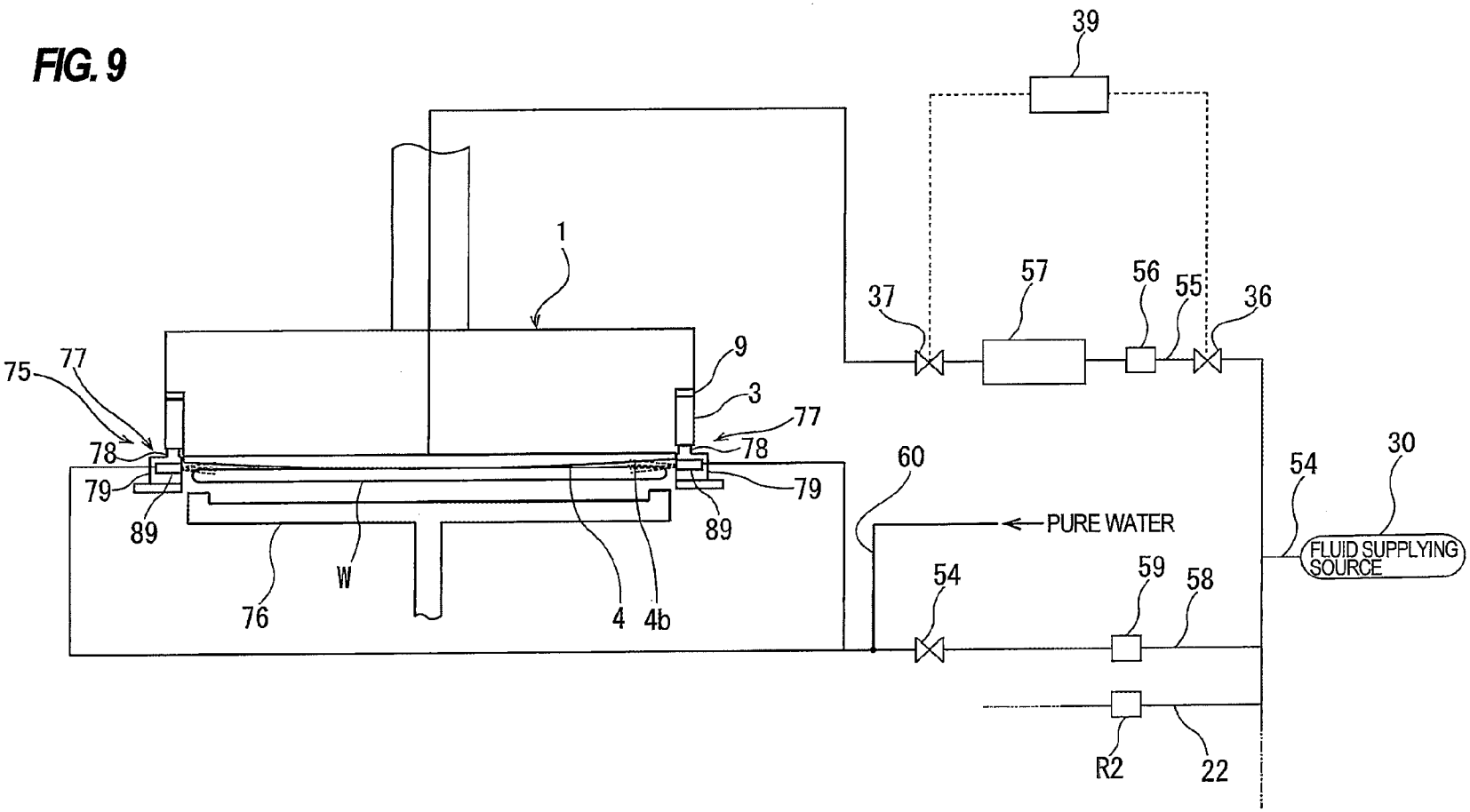
FIG. 9 is a schematic view illustrating an embodiment of a polishing apparatus in which, instead of the pusher, a retainer-ring station and a transfer stage are provided as a substrate transfer device.
Figure 10:
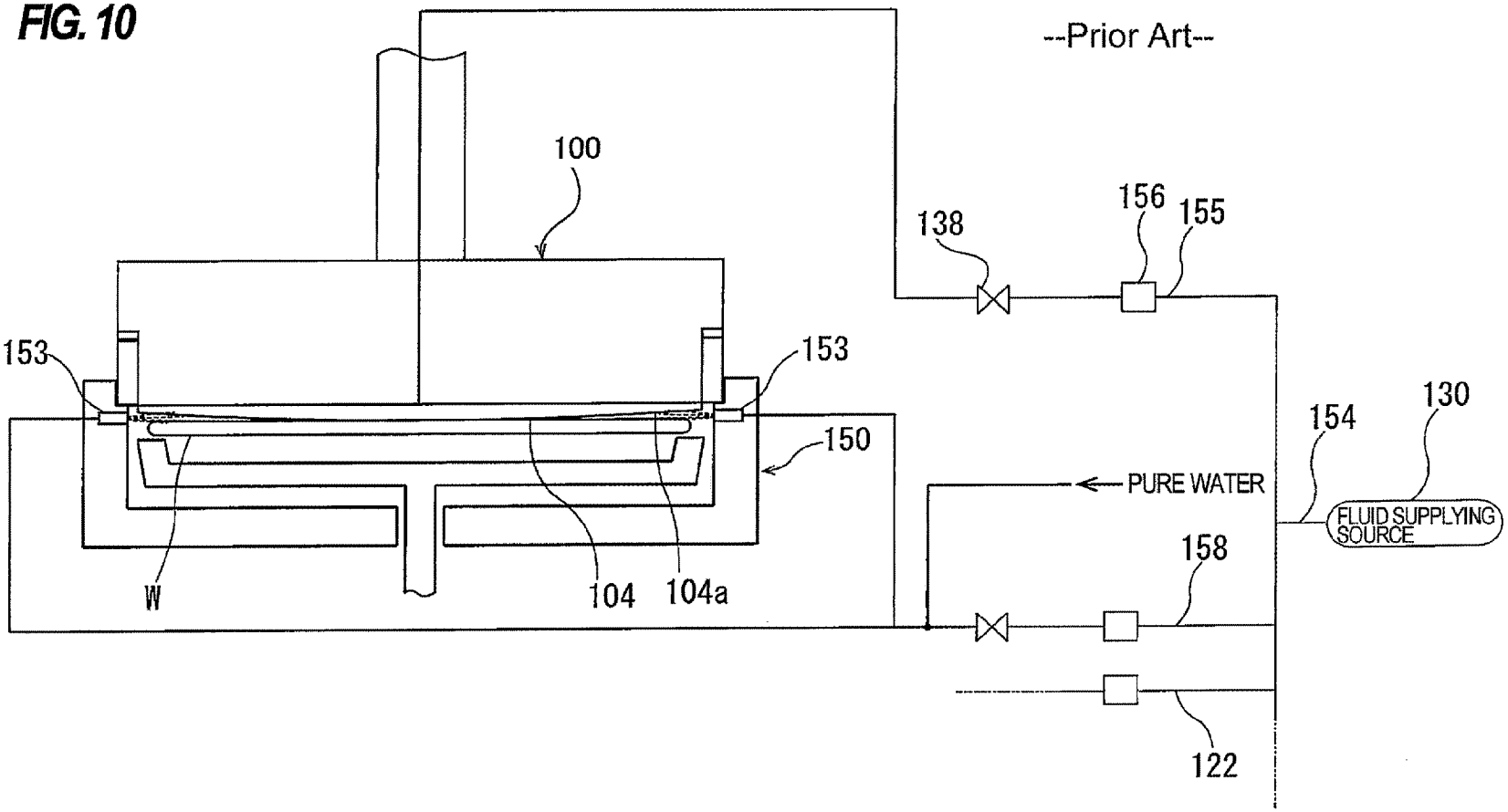
FIG. 10 is a schematic view showing a wafer releasing operation in which a wafer is released from a membrane.

FIG. 9 is a schematic view illustrating an embodiment of a polishing apparatus in which, instead of the pusher, a retainer-ring station and a transfer stage are provided as a substrate transfer device. Other structures in this embodiment are the same as those of the embodiment shown in FIG. 5. Therefore, the corresponding elements are denoted by identical reference numerals, and detailed descriptions thereof are omitted.

A position of the retainer-ring station 75 is fixed, while the transfer stage 76 is movable in the vertical direction. The retainer-ring station 75 includes a plurality of lifting mechanisms 77 configured to lift the retainer ring 3 of the polishing head 1. A position of the lifting mechanisms 77 in the vertical direction is located between the polishing head 1 and the transfer stage 76. Further, the lifting mechanisms 77 and the transfer stage 76 are arranged so as not to interfere with each other.

Each of the lifting mechanisms 77 includes a lift pin 78 configured to contact the retainer ring 3, a spring (not shown) as a pressing mechanism configured to push the lift pin 78 upward, and a casing 79 housing the lift pin 78 and the spring therein. The lifting mechanism 77 is located such that the lift pin 78 faces the lower surface of the retainer ring 3. When the polishing head 1 is lowered, the lower surface of the retainer ring 3 is brought into contact with the lift pins 78. The springs have a pushing force that is large enough to push the retainer ring 3 upward. Therefore, as shown in FIG. 9, the retainer ring 3 is pushed upward by the lift pins 78 and is moved to a position above the wafer W.

The retainer-ring station 75 is provided with a plurality of release nozzles 89. These release nozzles 89 are arranged at predetermined intervals along a circumferential direction of the retainer-ring station 75. Each of the release nozzles 89 is configured to eject a fluid mixture (or releasing shower) of pressurized nitrogen and pure water in a radially inward direction of the retainer-ring station 75.

Next, the wafer releasing operation using the retainer-ring station 75 and the transfer stage 76 will be described. The polishing head 1, holding the polished wafer W, is moved to a predetermined position above the retainer-ring station 75. Subsequently, the polishing head 1 is lowered, and as shown in FIG. 9, the retainer ring 3 is pushed upward by the lifting mechanisms 77 of the retainer-ring station 75. While the polishing head 1 is lowered, the transfer stage 76 is elevated and moved to a position just below the polishing head 1 without contacting the retainer ring 3.

In this state, the pressure chamber of the polishing head 1 is pressurized at a low pressure (e.g., about 100 hPa) to inflate the membrane 4. As a result, a gap is formed between the peripheral edge of the wafer W and the membrane 4. The releasing shower, comprising the fluid mixture of the pressurized nitrogen and the pure water, is ejected into this gap from the release nozzles 89, thereby releasing the wafer W from the membrane 4. The wafer W is received by the transfer stage 76, and the transfer stage 76 is then lowered together with the wafer W. While the fluid mixture of the pressurized nitrogen and the pure water is used as the releasing shower in this embodiment, the releasing shower may be constituted by only a pressurized gas or only a pressurized liquid, or may be constituted by a pressurized fluid of other combination.

In the embodiment shown in FIG. 9 using the retainer-ring station 75, the same fluid supplying system as that shown in FIG. 5 is provided. More specifically, the pressure regulator 56 is attached to the fluid supply passage 55, and the fluid storage element 57 is located at the secondary side of the pressure regulator 56. The primary-side valve 36 is located at the primary side of the fluid storage element 57 and at the primary side of the pressure regulator 56. The secondary-side valve 37 is located at the secondary side of the fluid storage element 57. The primary-side valve 36 and the secondary-side valve 37 are coupled to the valve controller 39. The valve controller 39 is configured to control opening and closing operations of the primary-side valve 36 and the secondary-side valve 37.

In this embodiment, the valve controller 39 is configured to close the secondary-side valve 37, and open the primary-side valve 36 at predetermined timings before the wafer releasing operation is performed. Consequently, the fluid, having a desired pressure adjusted by the pressure regulator 56, is stored in the fluid storage element 57. When the wafer releasing operation is performed, the valve controller 39 closes the primary-side valve 36, and opens the secondary-side valve 37. Consequently, the fluid stored in the fluid storage element 57 is supplied into the pressure chamber of the polishing head 1, thereby inflating the membrane 4. Therefore, even if the primary-side pressure of the primary-side valve 36 changes, the fluid having a stable pressure can be supplied from the fluid storage element 57 into the pressure chamber of the polishing head 1. As a result, the membrane 4 can be inflated with a good reproducibility at all times, thereby making it possible to form a proper gap between the wafer W and the membrane 4. Therefore, the releasing shower is properly supplied into this gap, thereby reliably releasing the wafer W.

Although the fluid supplying system in the embodiment shown in FIG. 9 is the same as that shown in FIG. 5, the fluid supplying system shown in FIG. 6 or FIG. 8 may be applied to the embodiment shown in FIG. 9. Alternatively, as shown in FIG. 7, the plurality of fluid supply passages 55, which are coupled to the plurality of pressure chambers of the polishing head 1, respectively, may be provided.

Although the embodiments according to the present invention have been described above, it should be understood that the present invention is not limited to the above embodiments, and various changes and modifications may be made within the technical concept of the appended claims.

What is claimed is:

1. A polishing method comprising:

pressing a substrate against a polishing pad on a polishing table by a polishing head, which has a substrate holding surface and a pressure chamber formed by a membrane, while moving the polishing table and the polishing head relative to each other, thereby polishing the substrate;

opening a primary-side valve located at a primary side of a fluid storage element while keeping a secondary-side valve located at a secondary side of the fluid storage element in a closed state, thereby storing a fluid in the fluid storage element, the fluid having a pressure that has been regulated by a pressure regulator located on the primary side of the fluid storage element;

closing the primary-side valve to a closed state;

opening the secondary-side valve while the primary-side valve is in the closed state to supply the fluid from the fluid storage element into the pressure chamber, thereby inflating the membrane to form a gap between the substrate and the membrane; and ejecting a releasing shower into the gap, thereby releasing the substrate from the polishing head.

2. The polishing method according to claim 1, wherein the primary-side valve is located at a secondary side of the pressure regulator.

3. The polishing method according to claim 1, wherein the pressure chamber is one of pressure chambers, the primary-side valve is one of primary-side valves, the secondary-side valve is one of secondary-side valves, the fluid storage element is one of fluid storage elements, and the pressure regulator is one of pressure regulators, wherein opening of the primary-side valve comprises opening the primary-side valves located at primary sides of the fluid storage elements communicating with the pressure chambers respectively, while keeping a closed state of the secondary-side valves located at secondary sides of the fluid storage elements, thereby storing fluids, having pressures adjusted by the pressure regulators, in the fluid storage elements, respectively, and wherein opening of the secondary-side valve comprises opening the secondary-side valves while the primary-side valves are in a closed state to supply the fluids, which are stored in the fluid storage elements, into the pressure chambers, thereby inflating the membrane to form the gap between the substrate and the membrane.

4. The polishing method according to claim 3, wherein the secondary-side valves are opened in a predetermined order while the primary-side valves are in the closed state, thereby supplying the fluids from the fluid storage elements into the pressure chambers in a predetermined order.

5. A polishing method comprising:

pressing a substrate against a polishing pad on a polishing table by a polishing head, which has a substrate holding surface and a pressure chamber formed by a membrane, while moving the polishing table and the polishing head relative to each other, thereby polishing the substrate;

storing a fluid in a fluid storage element while keeping a secondary-side valve located at a secondary side of the fluid storage element in a closed state, the fluid having a pressure that has been regulated by a pressure regulator located on a primary side of the fluid storage element;

opening the secondary-side valve to supply the fluid from the fluid storage element into the pressure chamber, thereby inflating the membrane to form a gap between the substrate and the membrane; and ejecting a releasing shower into the gap, thereby releasing the substrate from the polishing head, wherein a passage volume, including the fluid storage element, from the pressure regulator to the secondary-side valve is equal to or greater than a passage volume from the secondary-side valve to the pressure chamber.

6. A polishing apparatus comprising:

a polishing table for supporting a polishing pad;

a substrate holder having a substrate holding surface and a pressure chamber formed by a membrane, the substrate holder being configured to be able to hold a substrate on the substrate holding surface and press the substrate against the polishing pad by a pressure in the pressure chamber;

a fluid supply passage coupled to the pressure chamber;

a pressure regulator attached to the fluid supply passage;

a fluid storage element attached to the fluid supply passage and located at a secondary side of the pressure regulator;

a primary-side valve attached to the fluid supply passage and located at a primary side of the fluid storage element;

a secondary-side valve attached to the fluid supply passage and located at a secondary side of the fluid storage element; and a valve controller configured to control opening and closing operations of the primary-side valve and the secondary-side valve, the valve controller being configured to open the primary-side valve while keeping the secondary-side valve in a closed state to store a fluid, having a pressure adjusted by the pressure regulator, in the fluid storage element, and open the secondary-side valve while keeping the primary-side valve in a closed state to supply the fluid from the fluid storage element into the pressure chamber to thereby inflate the membrane.

7. The polishing apparatus according to claim 6, wherein the primary-side valve is located at a secondary side of the pressure regulator.

8. The polishing apparatus according to claim 6, wherein the pressure chamber is one of pressure chambers, the primary-side valve is one of primary-side valves, the secondary-side valve is one of secondary-side valves, the fluid storage element is one of fluid storage elements, and the pressure regulator is one of pressure regulators, wherein the valve controller is configured to open the primary-side valves while keeping the secondary-side valves in a closed state to store fluids, having pressures adjusted by the pressure regulators, in the fluid storage elements, respectively, and open the secondary-side valves while keeping the primary-side valves in a closed state to thereby supply the fluids from the fluid storage elements into the pressure chambers to inflate the membrane.

9. The polishing apparatus according to claim 8, wherein the valve controller is configured to open the secondary-side valves in a predetermined order while the primary-side valves are in the closed state to thereby supply the fluids from the fluid storage elements into the pressure chambers in a predetermined order.

10. A polishing apparatus comprising:

a polishing table for supporting a polishing pad;

a substrate holder having a substrate holding surface and a pressure chamber formed by a membrane, the substrate holder being configured to be able to hold a substrate on the substrate holding surface and press the substrate against the polishing pad by a pressure in the pressure chamber;

a fluid supply passage coupled to the pressure chamber;

a pressure regulator attached to the fluid supply passage;

a primary side of a fluid storage element attached to the fluid supply passage and located at a secondary side of the pressure regulator;

a secondary-side valve attached to the fluid supply passage and located at a secondary side of the fluid storage element; and a valve controller configured to control opening and closing operations of the secondary-side valve, the valve controller being configured to close the secondary-side valve to store a fluid, having a pressure regulated by the pressure regulator, in the fluid storage element, and open the secondary-side valve to supply the fluid, which is stored in the fluid storage element, into the pressure chamber to inflate the membrane, wherein a passage volume, including the fluid storage element, from the pressure regulator to the secondary-side valve is equal to or greater than a passage volume from the secondary-side valve to the pressure chamber.

* * * * *